United States Patent [19]

Buonaiuto

[11] 3,980,005

[45] Sept. 14, 1976

[54] SYNTHETIC PLASTIC FOAM CARTON LINERS

[76] Inventor: Robert B. Buonaiuto, 12 Bayview Road, Ipswich, Mass. 01938

[22] Filed: Nov. 20, 1974

[21] Appl. No.: 525,586

[52] U.S. Cl. ..... 93/36.01; 93/58 ST; 427/289

[51] Int. Cl.[2] ..... B31B 49/02

[58] Field of Search ..... 93/36.6, 58 ST, 58 R, 93/36.01, 41, 36.9, 56 R, 36 R; 229/14 C; 220/334, 9 F, DIG. 14; 156/264, 211, 217, 257; 427/289; 264/139, 154

[56] References Cited

UNITED STATES PATENTS

| | | | |
|---|---|---|---|
| 1,937,858 | 12/1933 | Taber | 427/289 |
| 3,092,529 | 6/1963 | Pearson | 156/257 X |
| 3,251,382 | 5/1966 | Tatsch | 220/9 F |
| 3,442,415 | 5/1969 | Glass | 220/334 |
| 3,595,287 | 7/1971 | Indermark | 83/5 X |
| 3,605,534 | 9/1971 | Barr | 83/5 |
| 3,675,808 | 7/1972 | Brink | 229/30 X |

*Primary Examiner*—James F. Coan

[57] ABSTRACT

Shipping carton liner and method for making the same, which consists of a unitary sheet of synthetic plastic foam composed of a pluality of panels separated by grooves or score lines of sufficient depth and of a configuration to enable the panels to be swung from coplanar to mutually perpendicular orientation. A resilient layer is applied to the foam, at least along the score line portions thereof and is characterized by a tear strength and flexibility greater than said foam. In one embodiment, the resilient layer is obtained by forming a densified skin on the surface of the foam. The layer of resilient material and the score lines form a hinge for the pivotal movement of the panels. Apparatus is also provided for fabricatng such liners or cartons.

2 Claims, 12 Drawing Figures

Fig. 3.
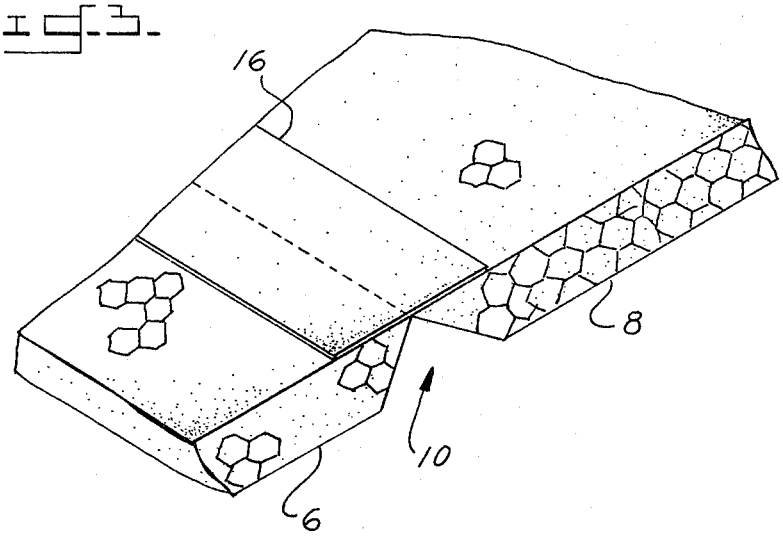
Fig. 4.
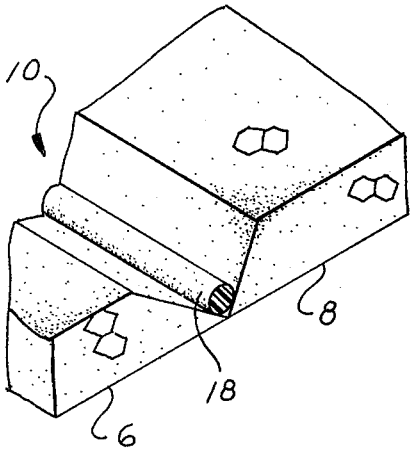
Fig. 5.
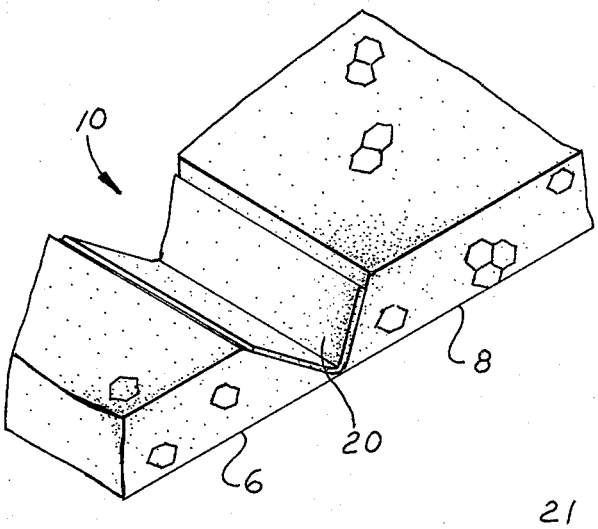
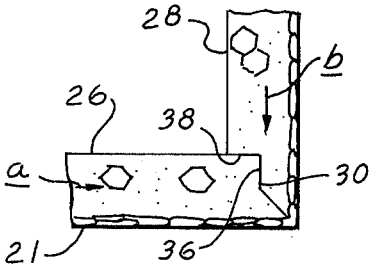
Fig. 7
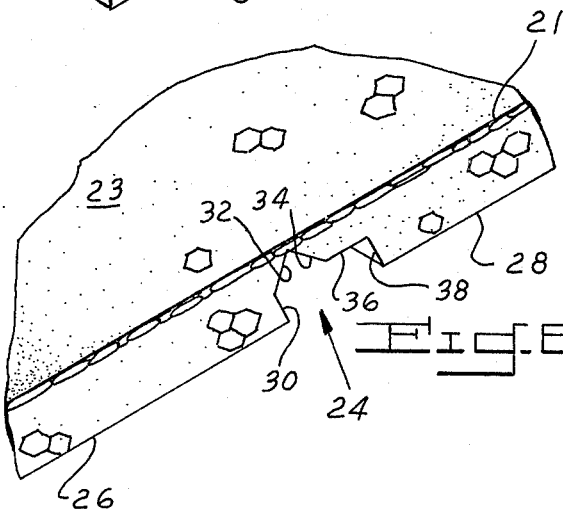
Fig. 6.

SYNTHETIC PLASTIC FOAM CARTON LINERS

BACKGROUND

The formation of composite shipping cartons by bonding low density plastic foam to the inner surfaces of the fiber board panels forming the carton has been known for some time. One such composite container is disclosed in U.S. Pat. No. 3,344,973. However, because of the excellent insulating properties of both the foam and the fiber board material, the lamination of such cartons does not lend itself to heat sealing techniques. As a consequence, special bonding agents and adhesives must be utilized to achieve such lamination. In addition, the laminating apparatus used to make such cartons must be adapted to handle both the fiber board and the foam material simultaneously, causing processing complexities because of the cumbersome and rigid materials being bonded together. Furthermore, the manufacturer of such composite cartons will have to maintain relatively large inventories of both the foam and fiber board, which require relatively large storage space. In addition, shipment costs of the completed cartons are relatively high because of the bulky and rigid nature of the composite carton consisting of two layers bonded together.

The principal object of this invention is to provide an improved shock-resistant container or liner which may be readily set up in box form.

Another object of this invention is to provide an economical method of fabricating shock-resistant liners.

A further object of this invention is to provide apparatus for fabricating shock-resistant liners of synthetic plastic foam from unitary sheets of foam.

The above and other objects and advantages of this invention will be more readily apparent from the following description and with reference to the accompanying drawings, in which:

FIGS. 3–7 are partial perspective views showing alternative hinge constructions, on an enlarged scale, of liners embodying this invention;

Figure 1:
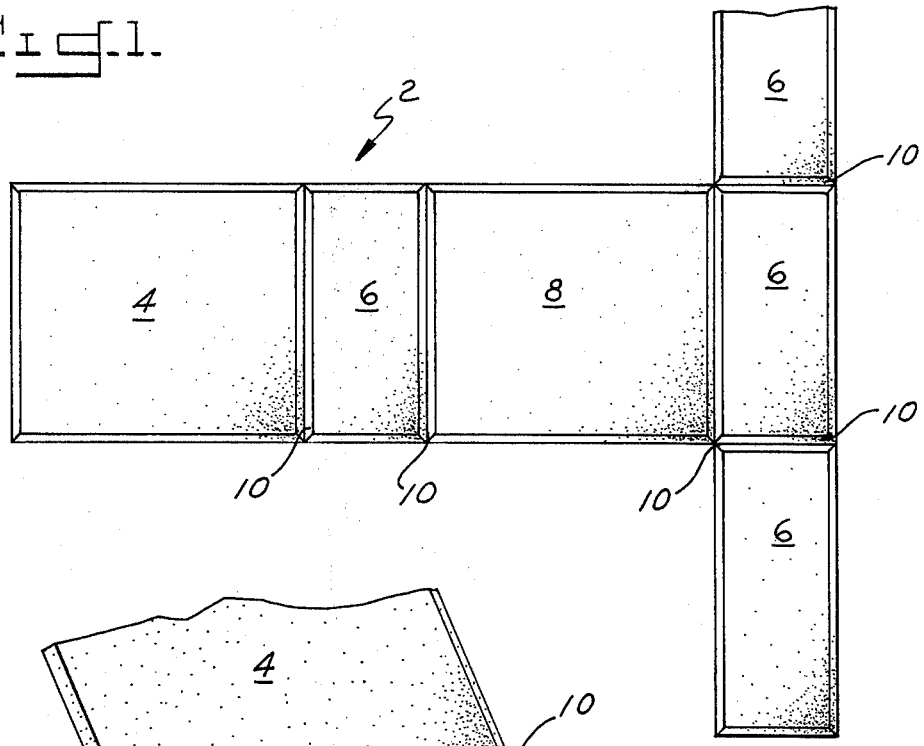
FIG. 1 is a plan view of a liner blank made in accordance with this invention.

Referring in detail to the drawings, in FIG. 1 is shown a blank 2 of synthetic plastic foam, such as polystyrene foam, which is a low density heat and shock absorbing material, ideal for a protective shipping carton or liner for the shipping and handling of fragile articles.

Figure 2:
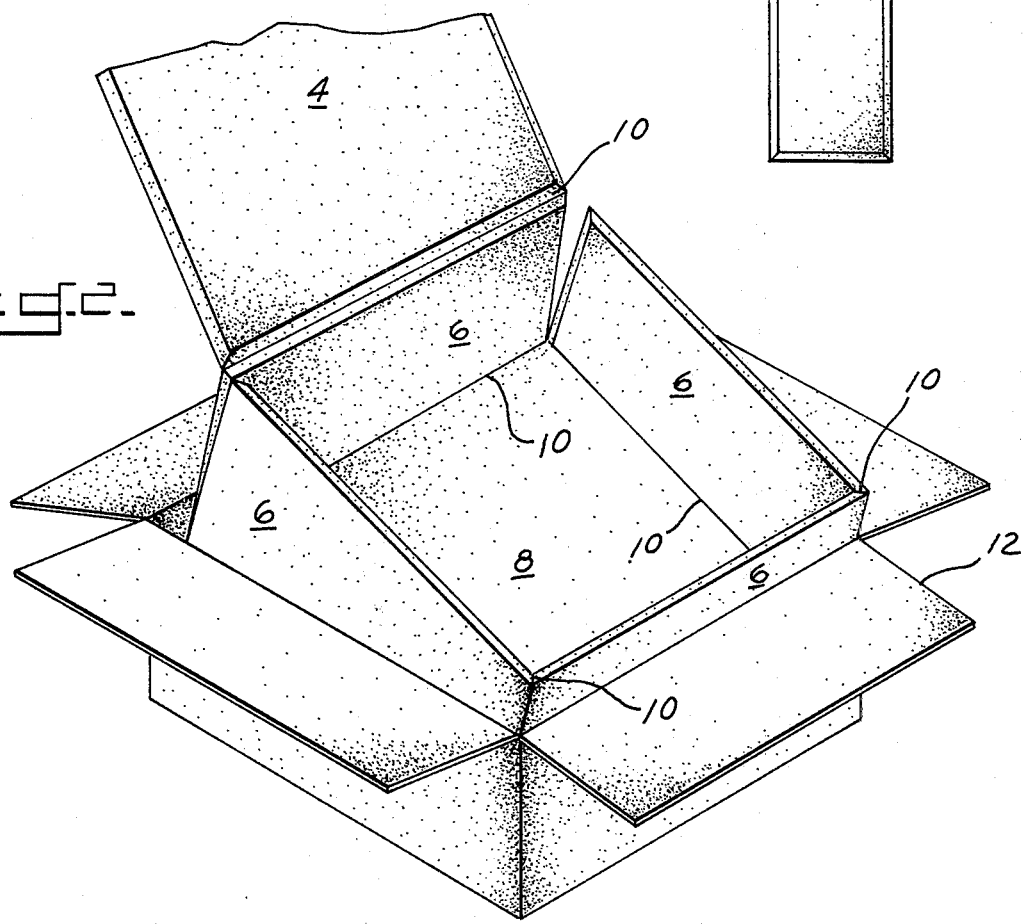
FIG. 2 is a perspective view showing the liner set up for insertion into a packing carton.
Figure 8:
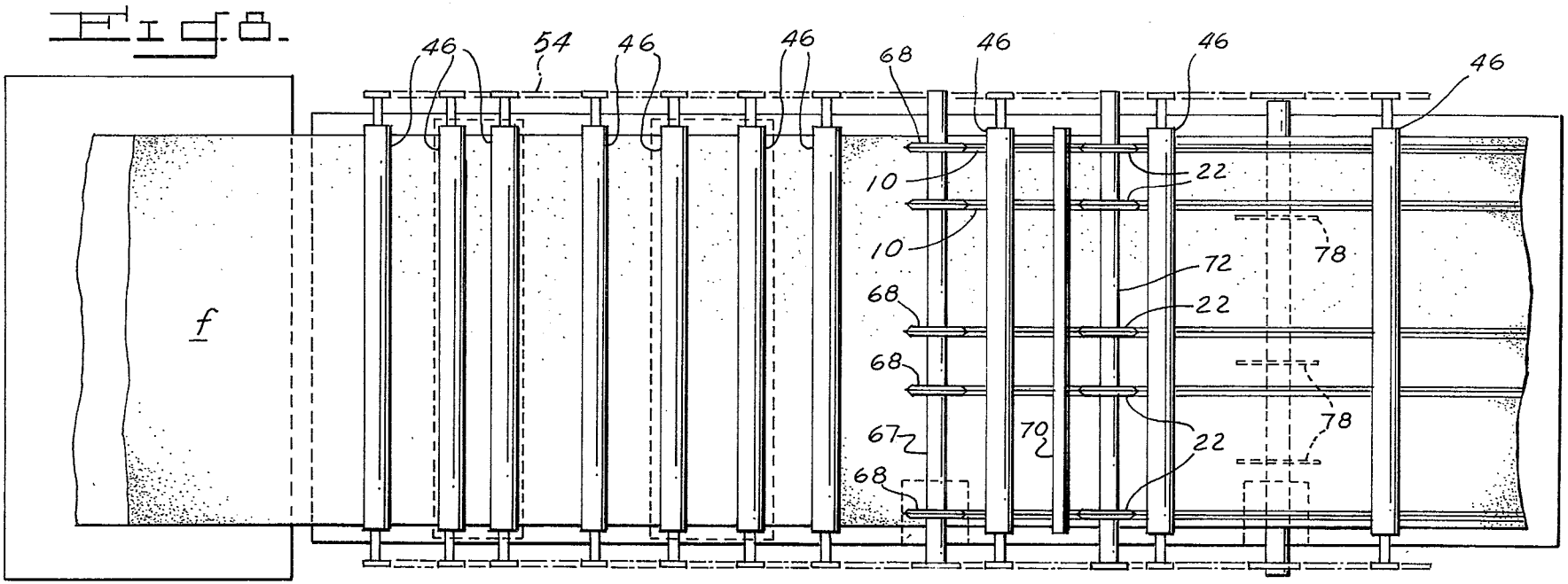
FIG. 8 is a plan view of a machine embodying this invention.

The liner 2 is formed from a unitary sheet of plastic foam and is composed of a plurality of distinct panels, shown in the drawings as panels 4, 6 and 8. The panels are delineated by grooves, channels or score lines 10. In the embodiment shown, panel 4 serves as the cover or top panel of a carton liner, panels 6 as the side walls and panel 8 as the bottom. In the embodiment depicted in FIGS. 1 and 2, the score lines or grooves 10 are generally V-shaped in cross section and of sufficient depth to enable the respective panels to be pivoted or swung from coplanar orientation as in FIG. 1 to a mutually perpendicular relation as illustrated in FIG. 2, whereby the liner may be readily set up or folded into a box-like assembly and used as a carton or fitted into a similarly shaped container or paper box carton 12. The score lines 10 may be formed by various techniques, such as by cutting or abrading with an abrasive wheel, or by densifying the foam by the application of heated forming wheels which soften or melt the foam where applied and by pressure shape the softened foam to the desired configuration.

Within the purview of this invention various hinge arrangements are contemplated for the foam liner, such as shown in FIGS. 3–7. In FIG. 3, two adjacent foam panels, designated as panels 6 and 8, are delineated by channels or grooves as at 10. On the surface of the foam opposite the beveled groove 10 a reinforcing layer of sheet material which covers the overall surface of the foam, or a narrow strip thereof as at 16, may be provided. The material selected is of suitable tear strength resilience and flexibility to enable the panels to be swung from coplanar into mutually perpendicular orientation with the beveled edges of adjacent panels abutting in surface-to-surface engagement as the liner is disposed within a carton, as shown in FIG. 2. This arrangement provides a rigid box-like liner of excellent structural strength, which can readily be set up within a carton or collapsed to flat condition for shipment and storage. The overall reinforcing layer coextensive with the foam sheet or narrow strip 16 may be formed of any suitable material, such as paper, synthetic plastic or metal foil coated with a pressure sensitive adhesive. Alternatively, the reinforcing layer may be laminated to the foam using a heat responsive adhesive by contacting the layer with a heated surface or platen, as will hereinafter be described. Another technique of applying a resilient backing layer involves the deposition of an elastomer which may be a thermoplastic resin heated to its melt temperature as hereinafter described, to provide an overall layer on the outer surface of the foam opposite the groove 10. Alternatively, a narrow strip of elastomer somewhat greater than the width of the hinge groove may be sprayed on the foam. Such a material may be applied either in a hydrocarbon vehicle or in an emulsion which may be sprayed or otherwise suitably applied to the back side of the foam along the hinge area opposite the groove. Upon evaporation of the vehicle, a deposition of elastomer particles remains which forms a flexible hinge. Such materials may, if necessary, also be heated to an appropriate temperature so that a strong adhesive bond is formed between the elastomer deposit and the foam.

Suitable materials for this deposition process include materials of low molecular weight, such as:

polyvinyl acetate polymers, polyvinyl chloride - vinyladene chloride copolymers, polyvinyl chloride homopolymers and copolymers plasticized with conventional plasticizers such as dioctyl phthalate, polyvinyl acrylate homopolymers and reactive copolymers.

Additionally, solutions of various polymers and copolymers and hydrocarbons may be used, such as:

natural rubbers, butadiene polymers and copolymers with styrene and acrylanitrile in suitable solvents, including heptane, toluene xylene and mixtures thereof. Also polyurethane in toluene may be used.

Figure 11:
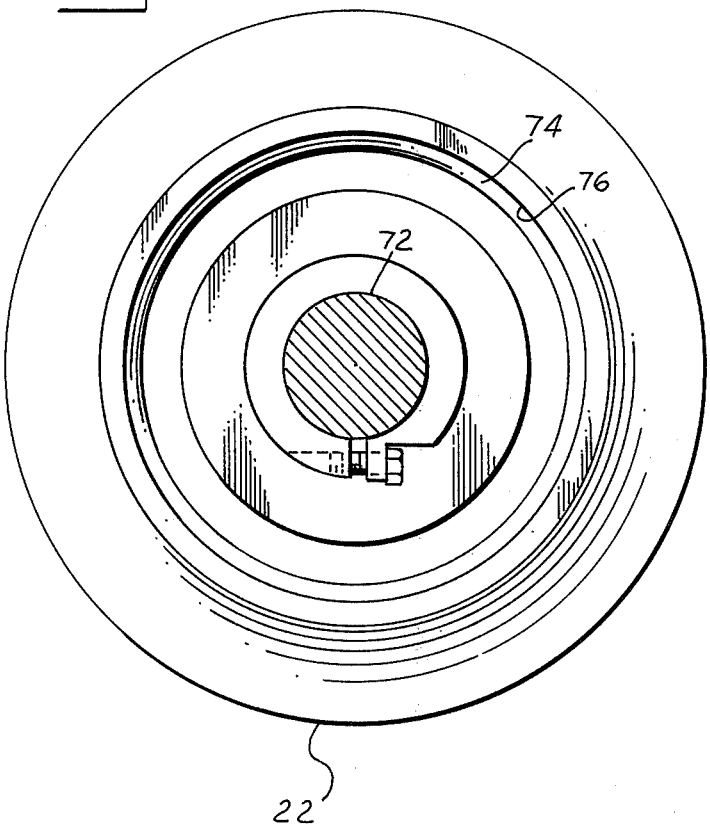
FIG. 11 is a side elevational view of a component of the machine.
Figure 12:
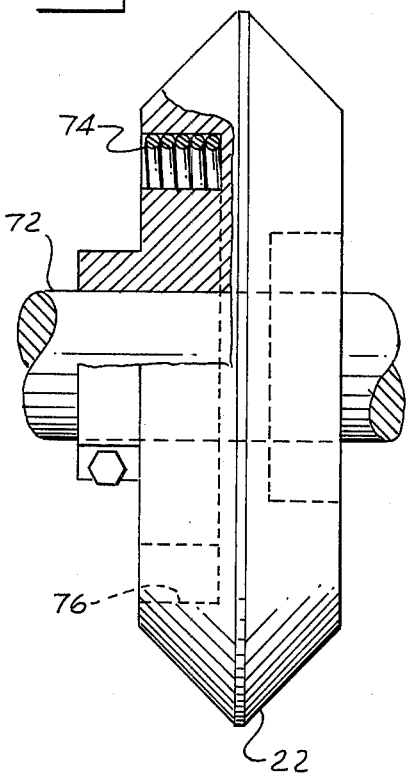
FIG. 12 is an end elevational view of the component shown in FIG. 11.

In FIGS. 4 and 5 is shown an alternate hinge construction and method of applying a high tear strength flexible material into the grooves between the foamed panels 6 and 8. In this illustrated embodiment, a bead of thermoplastic 18 is applied, such as by extrusion into the groove. Subsequently, the bead is heated to its softening or melt temperature and a forming tool, such as a roll, is applied to the bead so that it flows or is moved by pressure of the roll to form a film or coating 20 over the beveled surfaces forming the groove. Upon cooling, the coating 20 hardens or cures to form a flexible hinge of desirable tear strength having a strong adhesive bond with the foam. A suitable implement for carrying out this step is shown in FIGS. 11 and 12 and is in the form of a heated wheel 22 having a generally triangular shaped periphery. The periphery of the wheel may be coated with Teflon so as not to stick to the plastic material.

Suitable materials for this type of application in the grooves include:

Copolymers and analog terpolymers of monomer consisting of butadiene, styrene and acrylanitrile, formulated with various low melting resins and rosins to produce mixtures with fixed melting ranges known as hot melt thermoplastic resins. Homopolymers and copolymers of isoprene, ethylene, propylene and reactive terpolymers commonly referred to as synthetic rubbers compounded with or without resins and rosins to produce various melting range properties.

In FIG. 6 is shown a modified form hinge for shock resistant container or liner wherein a densified layer or skin 21 is formed in the outer surface portion of the foam sheet opposite the opening of groove 24. The densified layer 21 may be formed during fabrication of the liner by the application of heat and pressure whereby the surface 23 is melted or softened sufficiently to enable compaction of the foam cells or pores with the result being that a tough, resilient, tear resistant skin is formed. This skin, combined with an oppositely facing groove shown at 24, serves as a hinge for the swinging movement of the foam panels 26 and 28 about the hinge 24. While the skin 21 is shown in combination with a five-sided groove 24, it is, of course, equally applicable to a hinge groove of any desired cross section, including the V-shaped groove 10 shown in FIG. 3.

The groove 24 may be formed by a grinding wheel or heating wheel having a multi-faceted outer rim portion corresponding to the surfaces 30-38, shown in FIG. 6. The surfaces 32 and 34 form the inner portion of the groove 24 and diverge from the skin 21 outwardly with a dihedral angle of approximately 90° therebetween. From the outer edge of surface 32, a surface 30, at an obtuse angle to surface 32, extends to the panel 26 generally perpendicular thereto. From the outer edge of the surface 34 the groove 24 includes a shoulder 36 which is generally parallel to panel 28 and disposed at an obtuse angle to surface 34, which angle is the supplement of the obtuse angle between surfaces 30 and 32. The width of the shoulder 36 is approximately equal to the height of the surface 30 so that when the surface 30 rests upon the shoulder 36, the panel 26 abuts the outwardly extending surface 38. This groove configuration provides improved rigidity because there is substantially greater area of surface-to-surface engagement between the surface portions of respective panels 26 and 28 than is the case with a V-shaped groove as illustrated in FIG. 3.

In addition, as shown in FIG. 7, the shoulder 36 engages surface 30 in a plane perpendicular to the direction of thrust toward the panel 28 as illustrated by arrow *a*, thus minimizing the shearing force transmitted to the hinge material at the outer corner of the two panels. Moreover, surface 38 engages the surface of panel 26 in a plane perpendicular to the direction of thrust of panel 28 toward panel 26, as illustrated by arrow *b*, also minimizing shearing force transmitted to the hinge area. The overall effect of this multisided groove configuration is greater structural strength and rigidity.

Figure 9:
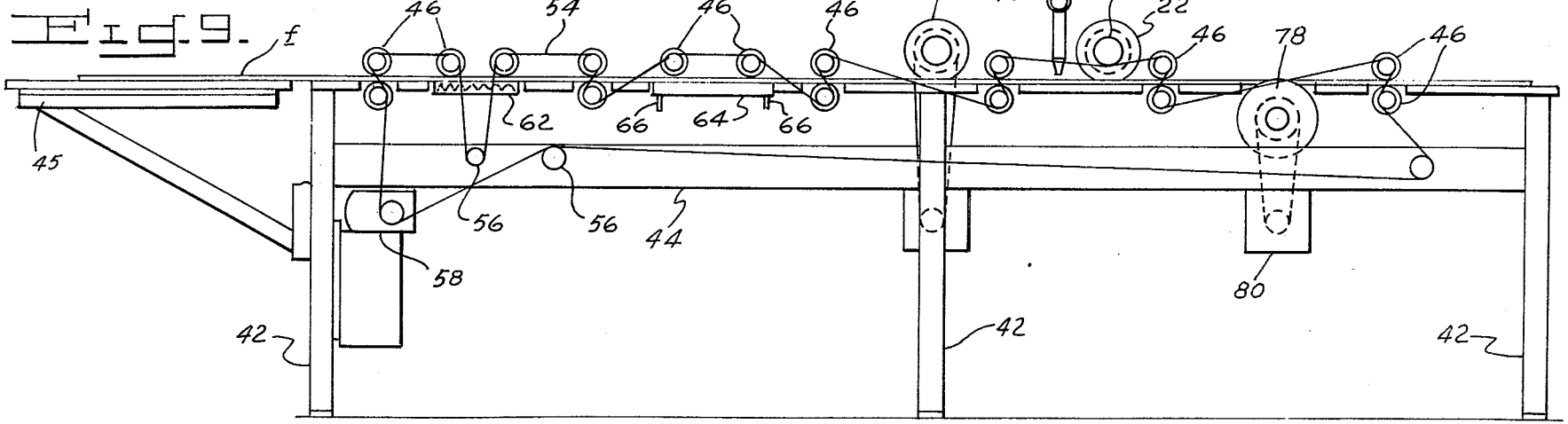
FIG. 9 is an elevational view of the machine shown in FIG. 8.
Figure 10:
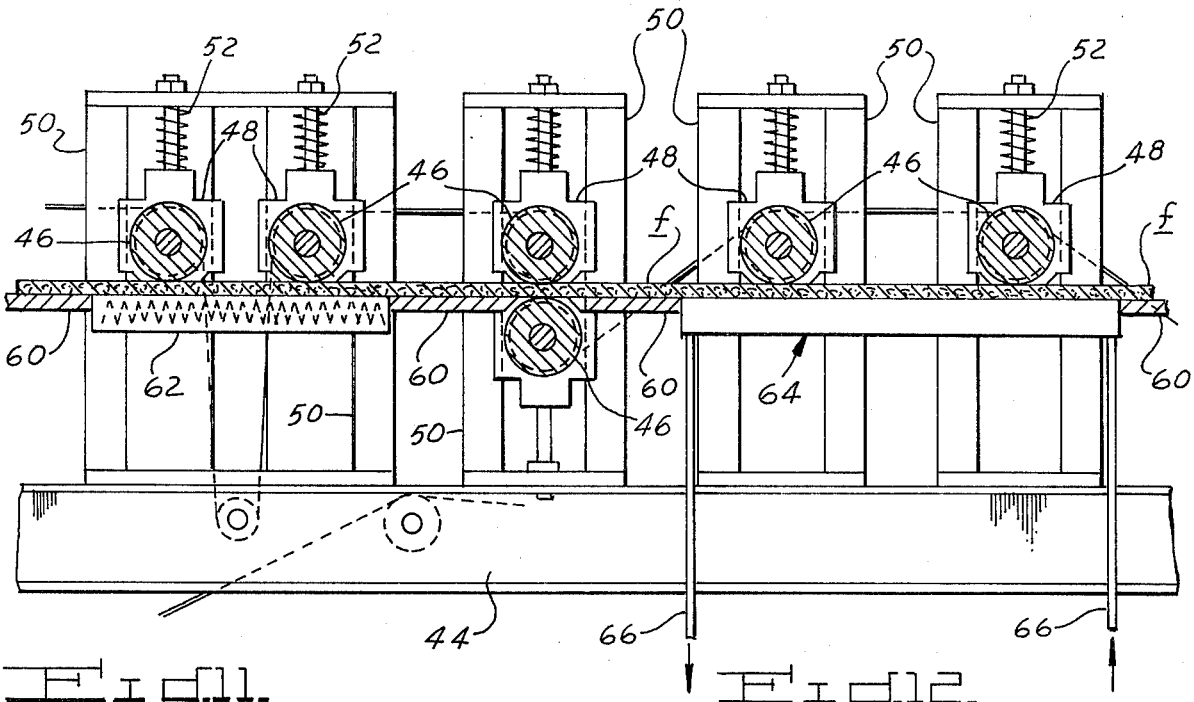
FIG. 10 is an elevational view showing a portion of the machine.

In FIGS. 8–12 a machine is shown of a type suitable for making packing cartons or liners embodying this invention. The apparatus comprises a plurality of upstanding legs 42 which provide the base for the machine and a pair of longitudinally extending, laterally spaced beams 44 which, together with the legs, form an elongated table-like structure. A leaf 45 extends outwardly at the input end of the machine onto which foam sheets *f* are fed into the machine. A plurality of feed rollers 46 extend laterally across the upper surface of the table. Each roller is mounted on a shaft supported in bearing blocks 48, FIG. 10, disposed on opposite ends of each roller shaft. Each bearing block 48 is supported in a rectangular frame or bracket 50 disposed on each side of the table and supported by the beams 44, as shown in FIG. 10. The bearing blocks 48 are appropriately grooved and vertically slidable on the upright members of the frame 50. Coil springs 52 are provided to urge the bearing blocks 48 downwardly, whereby the surfaces of the rollers 46 are spring urged into contact with the upper surface of the foam *f*. The outer ends of the shaft of the rollers 46 are provided with sprockets and are driven by an endless belt or chain 54, FIG. 9, whereby the rolls advance foam sheets through the machine from the input end. A plurality of idle gears, such as shown at 56, tension the drive belt or chain and define its path of travel as an elongated loop. The chain is driven by a suitable motor 58 which, as shown in FIG. 9, may be mounted on the base of the machine.

A plurality of plates 60, FIG. 10, extend across the machine from brackets 50 on one side of the machine to the other set of brackets on the opposite side. The plates 60 provide the working surface for the machine. A heating platen 62 extends across the width of the table in a space provided between adjacent edges of two longitudinally spaced plates 60. The heating plate may be heated by any suitable means, such as electrical heaters arranged in contact with the underside of the metal plate, so that the upper surface of the plate is generally heated to a uniform temperature over its entire area. The electrical heaters may be provided with a suitable control, such as a rheostat, so that the temperature may be controlled to achieve various foam treatments, including providing a densifying layer 21 on the undersurface of the foam, or activating a suitable heat responsive adhesive, whereby a layer of sheet material, such as paper, plastic or foil, may be bonded to the undersurface of the foam as it traverses the platen 62. The material may be of sufficient size to cover the entire sheet of foam or just along the back of the locations where the grooves are to be formed. If necessary or desirable, the platen 62 may be coated with a material, such as Teflon, so the softened foam will not adhere thereto.

Following the heater platen 62, the foam passes over another section of plates 60 and is then fed between a pair of rollers 46 which exert a compacting force on the foam. In this way, as a backing material is applied it will be firmly bonded to the undersurface of the foam sheet *f*. If on the other hand, the machine is being utilized to form a densified layer 21, as shown in FIG. 6, the pressure applied by the pair of rollers 46 will cause the layer of foam softened by the heating platen 62 to be compressed and upon cooling will be a tough resilient skin 21.

A cooling platen 64 is provided, as best shown in FIG. 10, which extends across the width of the machine between an adjacent pair of spaced plates 60. Tubes or conduits 66 provide cooling fluid to the interior of the cooling plate, which is appropriately chambered or cored to provide a generally uniform overall cooling by its upper surface. Following the cooling platen 64, a shaft 67 extends laterally across the machine and a plurality of laterally spaced grinding wheels 68 are carried by the shaft. The outer peripheral edge portion of the grinding wheels 68 may be of any suitable configuration to form shaped grooves or score lines, such as shown at 10, FIG. 3, or 24 in FIG. 6. The grinding wheels cut a series of parallel grooves into the foam sheet drawn thereby.

Foam being processed in the machine next passes an applicator which is shown generally at 70. The applicator consists of a transversely extending feed pipe from which extend a plurality of depending nozzles disposed in alignment with the grinding wheels 68 for depositing into the grooves cut in the form by the wheels 68 a coating of a bead of synthetic plastic, such as shown at 18 in FIG. 4. The plastic may be any material compatible with the foam which will form a tough resilient coating or layer bonded to the hinge area of the foam whereby the panels may be swung one relative to the other. Immediately following the applicator 70, the foam traverses a plurality of heating elements 22 supported on a shaft 72 extending laterally across the machine. The heating elements, as best shown in FIG. 2, are of generally circular configuration with a peripheral outer edge portion shaped to conform with the shape of the outer periphery of the grinding wheels 68. The periphery of the wheels is maintained at a suitably elevated temperature by an electrical resistance heater 74 disposed within recess 76 provided within the heating element. The resistance of the heating element 74 is selected so that the periphery of the wheel is maintained at a temperature to cause the plastic 18, FIG. 4, to be softened and to flow or be deformed by pressure into a thin film 20, FIG. 5, which is bonded to the beveled surfaces forming the grooves 10.

The foam sheet *f* is thereafter advanced over a plurality of laterally spaced rotary cutting blades 78 driven by motor 80 so that the grooved and coated foam is thereby cut into a plurality of longitudinal sections. Thereafter, each section of foam may be cut transversely into individual cartons or liners by any suitable means.

Having thus described this invention, what is claimed is:

1. Method of fabricating protective cartons and liners therefor comprising the steps of applying a thermoplastic resin, heated to its melt temperature, to a synthetic plastic foam sheet to form thereon an overall layer, cooling said resin to solidify the same and to form a resiliently flexible layer which has a tear strength and flexibility substantially greater than said foam, cutting grooves into said sheet of foam on the surface thereof opposite said resilient layer without cutting into said layer to form a plurality of panels delineated by said grooves, which are of sufficient depth and configuration to enable said panels to be swung into mutually perpendicular orientation, said resilient layer and foam forming a composite laminar structure in which said layer and grooves form flexible hinges for the pivotable movement of said panels into and out of said mutually perpendicular orientation.

2. Method of making protective cartons and liners therefor as set forth in claim 1, in which said thermoplastic layer includes an elastomer.

* * * * *